United States Patent [19]

Harandi

[11] Patent Number: 4,956,510

[45] Date of Patent: Sep. 11, 1990

[54] HYDROCARBON UPGRADING PROCESS AND REACTION SECTION DESIGN WITH REGENERATED CATALYST QUENCH

[75] Inventor: Mohsen N. Harandi, Lawrenceville, N.J.

[73] Assignee: Mobil Oil Corp., New York, N.Y.

[21] Appl. No.: 322,956

[22] Filed: Mar. 14, 1989

[51] Int. Cl.[5] ..... C07C 12/02; C07C 5/333; C10G 35/095

[52] U.S. Cl. ..... 585/415; 208/137; 208/138; 208/140; 422/198; 585/417; 585/419

[58] Field of Search ..... 208/137, 138, 140; 585/415, 417, 419, 660, 661

[56] References Cited

U.S. PATENT DOCUMENTS

| | | | |
|---|---|---|---|
| 3,756,942 | 9/1973 | Cattanach | 208/137 |
| 3,759,821 | 9/1973 | Brennan et al. | 208/93 |
| 3,760,024 | 9/1973 | Cattanach | 260/673 |
| 4,629,818 | 12/1986 | Burress | 585/417 |
| 4,851,602 | 7/1989 | Harandi et al. | 585/415 |

OTHER PUBLICATIONS

"M2 Forming–A Process for Aromatization of Light Hydrocarbons", Chen et al., 25 Ind. Eng. Chem. Process Des. Dev., 151 (1986).

*Primary Examiner*—Curtis R. Davis
*Attorney, Agent, or Firm*—Alexander J. McKillop; Charles J. Speciale; Robert B. Furr, Jr.

[57] ABSTRACT

Valuable product yield and catalyst useful life are improved by regenerating spent catalyst at temperatures below those maintained in the reaction zone. Relatively cold regenerated catalyst is then preheated and reactor effluent product is quenched by directly contacting the regenerated catalyst with hot reactor effluent product. The quenching step minimizes undesirable thermal cracking of valuable product to $C_2$-light gas. The process and apparatus are useful both in aromatization and dehydrogenation of aliphatic hydrocarbons.

25 Claims, 2 Drawing Sheets

HYDROCARBON UPGRADING PROCESS AND REACTION SECTION DESIGN WITH REGENERATED CATALYST QUENCH

The present invention relates to a method and apparatus for upgrading an aliphatic feedstream. More in particular, the invention relates to a method and apparatus for improving yield and selectivity as well as prolonging catalyst useful life in an aliphatic hydrocarbon upgrading process.

BACKGROUND OF THE INVENTION

Both yield and selectivity are essential elements in the economic viability of hydrocarbon upgrading processes. The net production of desired products depends not only on the quantity of reactants consumed, but also on the degree to which desirable conversion reactions can be favored over undesirable side reactions.

Competing side reactions decrease yield of the desired products in all conversion processes, but are both prominent and problematical in high temperature hydrocarbon conversion processes. At high temperatures above about 500° C. (930° F.) valuable products may easily undergo thermal cracking to much less valuable $C_2$-light gas. To avoid product loss due to side cracking reactions, it is necessary to cool the conversion reaction product stream to a temperature below its thermal cracking temperature immediately upon its withdrawal from the high temperature fluid-bed reaction zone. While thermal cracking may occur in the catalytic reaction zone, it is believed not to be detrimental to product yields due to the fact that the cracking products evolved in the catalytic reaction zone enter into the upgrading reactions and are eventually recovered as valuable product.

Hydrocarbon upgrading processes useful in the present invention typically operate in moving or fluid beds of catalyst at temperature between about 500 ° and about 820° C. (930° and 1500° F.). Consequently, thermal cracking is believed to begin to erode product yields as soon as the product stream is withdrawn from the catalyst bed at high temperature. Once the product stream is no longer in contact with the catalyst, the light cracking products cannot be reacted to form valuable products.

The hot product stream may be cooled quickly and efficiently by direct exchange with a lower temperature gas stream. The cooling gas stream to be mixed with the reaction product stream is preferably relatively inert under reaction zone conversion conditions. Examples of such gases include nitrogen, hydrogen and light aliphatic hydrocarbons. The increase in process unit profitability by the addition of such a quench stream is offset to some degree by the incremental operating costs associated with injecting the quench stream and later separating the components of the quench stream from the product mixture.

Relatively low temperature regeneration of zeolite catalysts below 540° C. (1000° F.) has been found to extend the useful life of the catalyst. This phenomenon appears to be attributable to, among other mechanisms, a marked decrease in the rate of steam deactivation. A permanent, physical degradation of the catalyst crystalline structure, steam deactivation is understood to be an integral function of temperature, water partial pressure and exposure time.

While lower temperature catalyst regeneration is desirable to the extent that it extends catalyst life, it is undesirable to the extent that lower regeneration temperatures are necessarily accompanied by a transfer of less sensible heat from the regenerated catalyst to the fluid-bed reaction zone. This effect is especially deleterious in strongly endothermic, high temperature processes such as paraffin dehydrogenation and aromatization.

From the foregoing, it can well be appreciated that a process and apparatus for carrying out a high temperature, endothermic catalytic conversion reaction which permits both low-temperature catalyst regeneration as well as direct quenching of the reaction zone effluent product stream would be highly beneficial.

SUMMARY OF THE INVENTION

The present invention provides, in its method aspects, a process for upgrading an aliphatic feedstream in a moving or fluid bed of catalyst in which yield, selectivity and catalyst life are improved and undesirable product cracking is reduced by quenching the hot product stream with fresh regenerated catalyst. Directly quenching the hot product stream with relatively cool regenerated catalyst serves several important functions. First, direct contact maximizes heat transfer efficiency between the hot reaction product and the regenerated catalyst. Second, given that the temperatures of the regenerated catalyst and the hot reaction product will equilibrate almost instantaneously upon contact, the catalyst regenerator may be operated over a broader range of temperatures than was practical with previous process designs. More specifically, the regenerator may be operated at relatively low temperature in order to extend the useful life of the catalyst.

The inventive process includes both fluid bed and moving bed embodiments. In the moving bed embodiment, catalyst and feedstock enter a reaction zone near the top and flow downward together. Spent catalyst is withdrawn from a point near the bottom of the reaction zone and is regenerated. Product flows from the bottom of the reaction zone to a direct heat exchange zone where relatively cold regenerated catalyst quenches the hot product stream. The heated regenerated catalyst is then withdrawn from the direct heat exchange zone and is recycled to enter the reaction zone near the top.

The cold regenerated catalyst quench in the direct heat exchange zone rapidly cools the product stream to minimize product cracking. As an added benefit, the regenerated catalyst recovers heat from the product stream for direct transfer back to the reaction zone.

In the fluid bed embodiment of the invention, fresh regenerated catalyst quenches the product stream after the product stream flows out of the fluid bed. The fluid bed embodiment is typically operated in a sub-transport fluidization regime, preferably a turbulent sub-transport fluidization regime. Catalyst fines generated from physical attrition of the catalyst particles become entrained in the fluid-bed reaction product gas stream flowing out of the fluid-bed reaction zone. These fines are typically separated from the product stream in a cyclone separator positioned near the top of the reactor vessel.

Regenerated catalyst may be mixed with the hot effluent from the fluid-bed reaction zone at any convenient point downstream from the fluid-bed reaction zone taking into account the following limitations. The cool regenerated catalyst should be charged to the reactor vessel at a sufficient height above the fluid bed to avoid substantial direct cooling of the fluid bed. On the other hand, however, the hot fluid-bed reaction zone effluent should be cooled below its thermal cracking temperature as soon as possible after leaving the fluid bed to minimize the effect of thermal cracking. In the most preferred embodiment of the present invention, the relatively cool regenerated catalyst stream contacts the hot reaction product stream near the inlet horn of a cyclone separator. In addition to the advantages described above, the most preferred embodiment provides improved cyclone separator efficiency by mixing catalyst fines with larger catalyst particles inside the cyclone separator. While not presented to limit the scope of the invention by a recitation of theory, it is believed that increasing the average particle size present in the cylcone separator increases separation efficiency by promoting more favorable hydrodynamics within the separator.

The present invention includes, in its methods aspects, a process for converting an aliphatic feedstream comprising the steps of maintaining catalyst in a reaction zone, contacting the aliphatic feedstream with the catalyst in the reaction zone under conversion conditions evolving a product stream and at least partially deactivating the catalyst, separating the product stream from the catalyst, withdrawing a portion of the at least partially deactivated catalyst from the reaction zone, regenerating the withdrawn portion of at least partially deactivated catalyst at a temperature below that maintained in the reaction zone, and quenching the product stream by contacting the product stream with regenerated catalyst to lower the temperature of the product stream sufficiently to avoid substantial thermal cracking of the product stream to light $C_2$-hydrocarbons.

The invention includes, in one apparatus aspect, a process unit for converting an aliphatic feedstream comprising a reactor vessel having inlet and outlet ports, a cyclone separator positioned within an upper section of the reactor vessel, a catalyst regenerator vessel in valved communication with the reactor vessel, and conduit means for conveying a stream of regenerated catalyst from said regenerator vessel to said cyclone separator.

The invention also includes, in a second apparatus aspect, a process unit for converting an aliphatic feedstream comprising a reactor vessel for the co-current downward flow of solid catalyst and aliphatic hydrocarbon feed, a catalyst regenerator vessel in valved communication with said reactor vessel, a direct heat exchange chamber for contacting fresh regenerated catalyst with hydrocarbon product withdrawn from said reactor vessel to preheat the fresh regenerated catalyst and to quench the hydrocarbon product, conduit means for transferring fresh regenerated catalyst from said regenerator vessel to said direct heat exchange chamber, conduit means for transferring product from said reactor vessel to said direct heat exchange chamber, means associated with said direct heat exchange chamber for separating said preheated regenerated catalyst from said product stream, and conduit means for transferring said preheated regenerated catalyst to said reactor vessel.

DETAILED DESCRIPTION

Aromatization Process

Figure 1:
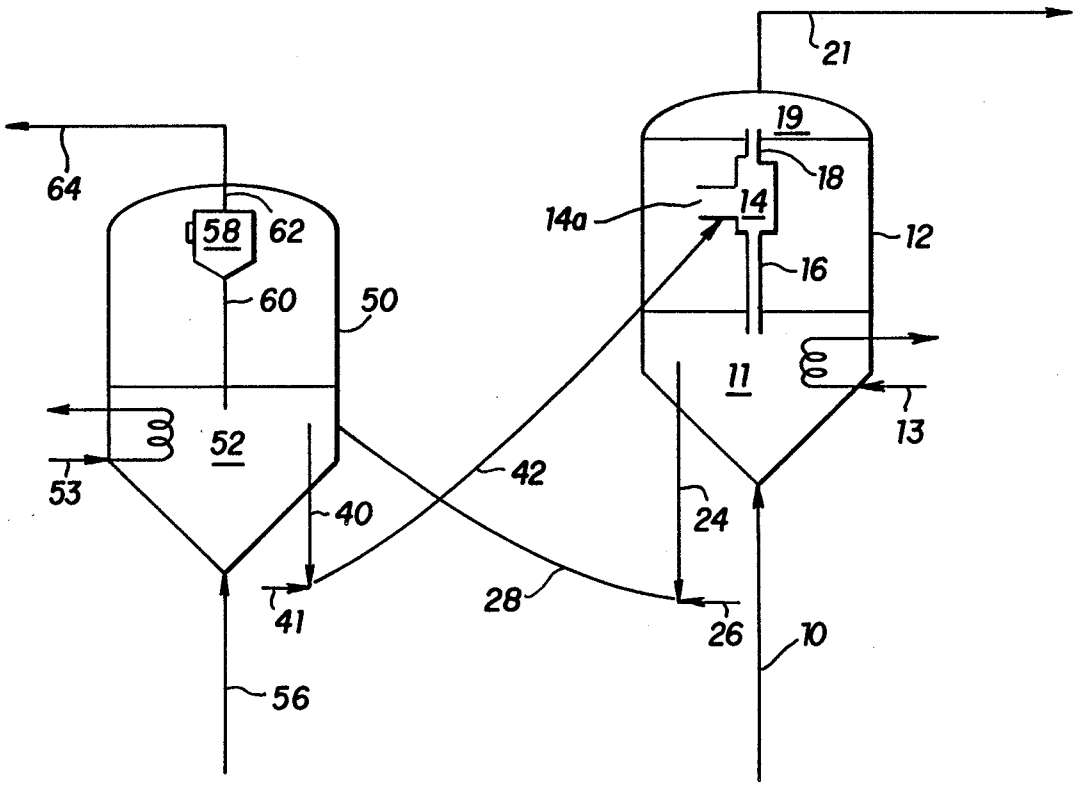
FIG. 1 is a simplified schematic flow diagram illustrating a first embodiment of the present invention in which the reaction zone contains a fluid bed of catalyst.

Hydrocarbon upgrading reactions compatible with the process of the present invention include the conversion of aliphatic hydrocarbons to aromatic and olefinic hydrocarbons. Such conversions are discussed by N. Y. Chen and T.Y. Yan in their article "M2 Foming-A Process for Aromatization of Light Hydrocarbons", 25 IND. ENG. CHEM. PROCESS DES. DEV. 151 (1986), the text of which is incorporated herein by reference. The following representative U.S. patents detail the feed compositions and process conditions for the aromatization and dehydrogenation reactions. Aromatization and dehydrogenation process conditions are summarized in Table 1.

U.S. Pat. No. 3,756,942, incorporated by reference as if set forth at length herein, discloses a process for the preparation of aromatic compounds in high yields which involves contacting a particular feed consisting essentially of mixtures of paraffins and/or olefins, and/or naphthenes with a crystalline aluminosilicate, e.g. ZSM-5, under conditions of temperature and space velocity such that a significant portion of the feed is converted directly into aromatic compounds.

U.S. Pat. No. 3,759,821, incorporated by reference as if set forth at length herein, discloses a process for upgrading catalytically cracked gasoline.

U.S. Pat. No. 3,760,024, incorporated by reference as if set forth at length herein, teaches a process for the preparation of aromatic compounds involving contacting a feed consisting essentially of $C_2$–$C_4$ paraffins and/or olefins with a crystalline aluminosilicate, e.g. ZSM-5.

Hydrocarbon feedstocks which can be converted according to the present process include various refinery streams including coker gasoline, light FCC gasoline, $C_5$–$C_7$ fractions of straight run naphthas and pyrolysis gasoline, as well as raffinates from a hydrocarbon mixture which has had aromatics removed by a solvent extraction treatment. Examples of such solvent extraction treatments are described on pages 706–709 of the *Kirk-Othmer Encyclopedia of Chemical Technology*, Third Edition, Vol. 9 (1980). A particular hydrocarbon feedstock derived from such a solvent extraction treatment is a Udex raffinate. Thus a paraffinic hydrocarbon feedstock suitable for use in the present process may comprise at least 75 percent by weight, e.g. at least 85 percent by weight, of paraffins having from 5 to 10 carbon atoms.

TABLE 1

| | |
|---|---|
| WHSV | Broad range: 0.3–500 $hr^{-1}$ |
| | Preferred range: 1–50 $hr^{-1}$ |
| OPERATING PRESSURE | Broad: 170–2170 kPa (10–300 psig) |
| | Preffered: 310–790 kPa (30–100 psig) |
| OPERATING TEMPERATURE | Broad: 500–820° C. (930–1500° F.) |
| | Preferred: 560–620° C. (1050–1150° F.) |

Aromatization Catalysts

The members of the class of zeolites useful in the aromatization reaction have an effective pore size of generally from about 5 to about 8 Angstroms, such as to freely sorb normal hexane. In addition, the structure must provide constrained access to larger molecules. It is sometimes possible to judge from a known crystal structure whether such constrained access exists. For example, if the only pore windows in a crystal are formed by 8-membered rings of silicon and aluminum atoms, then access by molecules of larger cross section than normal hexane is excluded and the zeolite is not of the desired type. Windows of 10-membered rings are preferred, although, in some instances, excessive puckering of the rings or pore blockage may render these zeolites ineffective.

Although 12-membered rings in theory would not offer sufficient constraint to produce advantageous conversions, it is noted that the puckered 12-ring structure of TMA offretite does show some constrained access. Other 12-ring structures may exist which may be operative for other reasons, and therefore, it is not the present intention to entirely judge the usefulness of the particular zeolite solely from theoretical structural considerations.

A convenient measure of the extent to which a zeolite provides control to molecules of varying sizes to its internal structure is the Constraint Index of the zeolite. The method by which the Constraint Index is determined is described in U.S. Pat. No. 4,016,218, incorporated herein by reference for details of the method. U.S. Pat. No. 4,696,732 discloses Constraint Index values for typical zeolite materials and is incorporated by reference as if set forth at length herein.

In a preferred embodiment, the catalyst is a zeolite having a Constraint Index of between about 1 and about 12. Examples of such zeolite catalysts include ZSM-5, ZSM-11, ZSM-12, ZSM-22, ZSM-23, ZSM-35 and ZSM-48.

Zeolite ZSM-5 and the conventional preparation thereof are described in U.S. Pat. No. 3,702,886, the disclosure of which is incorporated herein by reference. Other preparations for ZSM-5 are described in U.S. Pat. Nos. Re. 29,948 (highly siliceous ZSM-5); 4,100,262 and 4,139,600, the disclosure of these is incorporated herein by reference. Zeolite ZSM-11 and the conventional preparation thereof are described in U.S. Pat. No. 3,709,979, the disclosure of which is incorporated herein by reference. Zeolite ZSM-12 and the conventional preparation thereof are described in U.S. Pat. No. 3,832,449, the disclosure of which is incorporated herein by reference. Zeolite ZSM-23 and the conventional preparation thereof are described in U.S. Pat. No. 4,076,842, the disclosure of which is incorporated herein by reference. Zeolite ZSM-35 and the conventional preparation thereof are described in U.S. Pat. No. 4,016,245, the disclosure of which is incorporated herein by reference. Another preparation of ZSM-35 is described in U.S. Pat. No. 4,107,195, the disclosure of which is incorporated herein by reference. ZSM-48 and the conventional preparation thereof is taught by U.S. Pat. No. 4,375,573, the disclosure of which is incorporated herein by reference.

Gallium-containing zeolite catalysts are particularly preferred for use in the present invention and are disclosed in U.S. Pat. No. 4,350,835 and U.S. Pat. No. 4,686,312, both of which are incorporated by reference as if set forth at length herein.

Zinc-containing zeolite catalysts are useful in the present invention, for example, U.S. Pat. No. 4,392,989 and U.S. Pat. No. 4,472,535, both of which are incorporated by reference as if set forth at length herein.

Catalysts such as ZSM-5 combined with a Group VIII metal described in U.S. Pat. No. 3,856,872, incorporated by reference as if set forth at length herein, are also useful in the present invention.

Dehydrogenation Catalysts

Paraffin dehydrogenation catalysts also include oxides and sulfides of Groups IVA, VA, VIA, VIIA and VIIIA and mixtures thereof on an inert support such as alumina or silica-alumina. Thus, dehydrogenation may be promoted by sulfides and oxides of titanium, zirconium, vanadium, niobium, tantalum, chromium, molybdenum, tungsten and mixtures thereof. Oxides of chromium alone or in conjunction with other catalytically active species have been shown to be particularly useful in dehydrogenation. Other catalytically active compounds include sulfides and oxides of manganese, iron, cobalt, rhodium, iridium, nickel, palladium, platinum and mixtures thereof.

The above-listed metals of Groups IVA, VA, VIA, VIIA and VIIIA may also be exchanged onto zeolites to provide a zeolite catalyst having dehydrogenation activity. Platinum has been found to be particularly useful for promoting dehydrogenation over zeolite catalysts.

DESCRIPTION OF THE EMBODIMENTS

Fluid-bed Process

Referring to FIG. 1, a first embodiment of the present inventive concept is described, beginning with the reactor feedstream and proceeding then to the regenerator.

A preheated aliphatic charge stream flows through line 10 and enters fluid-bed reaction zone 11 which is maintained in a lower section of reactor 12. The aliphatic feedstream is preferably preheated to a temperature just below that at which coke precursors including oxygenates such as furfural and glycol thermally degrade to form coke. In the most preferred embodiment of the invention, the aliphatic feedstream flowing through line 10 is rich in paraffins and the fluid-bed reaction zone 11 contains an aromatization or dehydrogenation catalyst. Thus, the reaction carried out in fluid-bed reaction zone 11 is typically endothermic. Heat exchange assembly 13 which includes inlet and outlet lines passing through the wall of reactor vessel 12 further includes one or more heat exchange tubes positioned within the fluid-bed reaction zone 11. A hot fluid such as a flue gas supplements the heat input to fluid-bed reaction zone 11 by indirect exchange as it flows through heat exchange assembly 13.

The feedstream charge rate is maintained at a level sufficient to fluidize catalyst particles of the fluid bed in a sub-transport regime. Techniques known to those skilled in the art for maintaining such a fluidization regime include varying the cross sectional size and shape of reactor 12 as well as controlling the flow rate of the feedsteam entering the reactor through line 10.

As the fluid-bed reaction progresses, coke deposition causes the catalyst to become at least partially deactivated. A portion of the catalyst volume is continuously withdrawn from fluid-bed reaction zone 11 through line 24 for continuous regeneration as described below.

A reaction product mixture including upgraded product, unreacted feed and entrained catalyst fines flows upward out of fluid-bed reaction zone 11 and enters inlet horn **14*a* of cyclone separator 14. Relatively cool regenerated catalyst is withdrawn from continuous catalyst regenerator 50 via line 40, is mixed with an inert transfer gas, for example, flue gas, which is introduced via line 41 and flows fluidized in the transfer gas through line 42 to the inlet horn 14a of cyclone separator 14. The relatively cool regenerated catalyst is typically at a temperature below 540° C. (1000° F.) and rapidly cools the hot product mixture upon direct contact. Catalyst fines together with regenerated catalyst flow downward through dipleg 16 and enter fluid bed 11. The purified product mixture flows upward out of cyclone separator 14 through overhead line 18 into plenum chamber 19. The product mixture is subsequently withdrawn from plenum chamber 19 through outlet line 21**.

Turning now to the continuous regeneration section of the present invention, the catalyst which has been at least partially deactivated in fluid-bed reaction zone 11 is withdrawn via line 24 and mixed with transfer gas flowing through line 26. The transfer gas may include nitrogen, flue gas or other suitable gas streams. The fluidized mixture then enters line 28 and flows upwardly into a fluid-bed oxidative regeneration zone 52 maintained in a lower section of continuous regenerator vessel 50. Oxygen-containing regeneration gas, typically air, is charged to a lower section of continuous regenerator vessel 50 through line 56 at a rate sufficient to maintain the fluid-bed regeneration zone 52 in a state of sub-transport fluidization.

Oxidative regeneration is a strongly exothermic process in which coke is removed from the catalyst particles by controlled combustion. It is a critical limitation for the process of the present invention that the fluid-bed regeneration zone 52 be maintained at a temperature below that of fluid-bed reaction zone 11. By maintaining such temperature differential, the regenerated catalyst withdrawn from fluid-bed regeneration zone 52 effectively cools the reaction product mixture of fluid-bed reaction zone 11 by highly efficient direct contact.

Several techniques may be employed to maintain fluid-bed regeneration zone 52 within the desired range of temperatures. Such techniques include control of the regeneration gas composition and flow rate, as well as indirect heat withdrawal through heat exchange assembly 53. This heat exchange assembly includes inlet and outlet conduits passing through the wall of continuous regeneration vessel 50 together with at least one heat exchange tube positioned within fluid-bed regeneration zone 52. Most preferably, heat exchange apparatus 53 comprises a steam generation unit for indirectly withdrawing heat from fluid-bed regeneration zone 52.

The relatively cool regenerated catalyst flows out of fluid-bed regeneration zone 52 through line 40 and is fluidized in transfer gas flowing through line 41. The fluidized mixture enters line 42 and is charged to the inlet horn 14a of reactor cyclone 14 as described above.

Regenerator flue gas together with entrained catalyst fines flows into regenerator cyclone 58 positioned near the top of continuous regenerator vessel 50. Catalyst fines are returned to the fluid-bed regeneration zone 52 through dipleg 60, while the purified flue gas flows out of cyclone separators 58 through line 62 and subsequently is withdrawn from continuous regenerator 50 via line 64.

Moving-bed Process

The second embodiment of the present invention comprises a moving-bed catalytic aromatization process. It is to be understood that the use of a dehydrogenation catalyst as described above provides an olefinic rather than an aromatic product stream.

Figure 2:
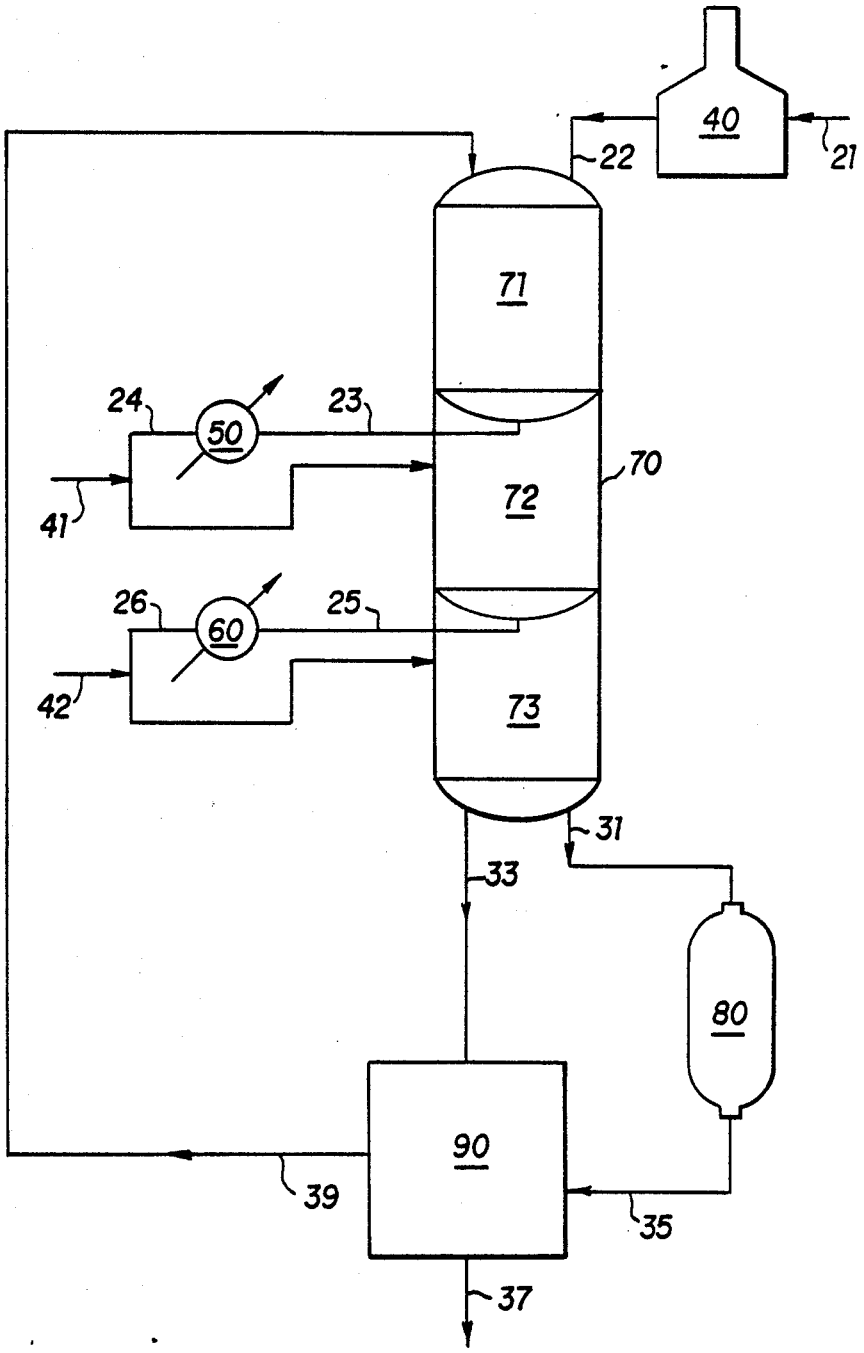
FIG. 2 is a simplified schematic flow diagram illustrating a second embodiment of the present invention in which the reaction zone contains a moving bed of catalyst.

Referring now to FIG. 2, an aliphatic feedstream is charged through line 21 to process furnace 40. The aliphatic feedstream is preferably heated to a temperature just below that at which coke precursors including oxygenates such as furfural and glycol thermally degrade to form coke. The heated feedstream is withdrawn from process furnace 40 and charged to a cylindrical reactor vessel 70 through line 22. Reactor vessel 70 contains at least one reaction zone, preferably at least two reaction zones. Reactor vessel 70 as shown contains three reaction zones 71, 72 and 73. Regenerated catalyst flows from direct heat exchange zone 90 through line 39 to the first reaction zone 71 inside reactor vessel 70. In each of the three reaction zones, catalyst flows downward and the reactants flow radially outward from central distributors (not shown).

In the first reaction zone 71 the predominant reactions include paraffin dehydrogenation and olefin aromatization. A first intermediate product stream is withdrawn from reaction zone 71 through line 23 and is charged to heat exchanger 50. Partially deactivated catalyst flows downward through reactor vessel 70 into a second reaction zone 72.

Heat exchanger 50 may be operated as a heating or cooling unit depending on the composition of the first intermediate product stream. If sufficient dehydrogenation and aromatization has occurred in the first reaction zone, the subsequent reaction zones may be operated as oligomerization zones. Otherwise, the second reaction zone must be operated at dehydrogenation/aromatization process conditions. If secondary reaction zone 72 is to be operated as an oligomerization zone, heat exchanger 50 is operated as a process cooler. On the other hand, if secondary reaction zone 72 is to be operated as a dehydrogenation/aromatization zone, heat exchanger 50 is operated to increase the temperature of the first intermediate product stream. As can be seen by one skilled in the art, if the first intermediate product stream must be heated, heat exchanger 50 may be replaced with a fired heater or other means for heating the first intermediate product stream.

A first intermediate product stream is cooled when it is desired to maintain subsequent reaction zones as oligomerization zones. Further, if subsequent reaction zones are to be operated as oligomerization reaction zones, a stream of $C_2$–$C_6$ olefins may optionally be added through line 41 to the first intermediate product stream in line 24. The mixture is then charged through line 24 to a secondary reaction zone 72. A second intermediate product stream is withdrawn from reaction zone 72 and charged to process heater or cooler 60 through line 25. The heat exchanged second intermediate product stream flows out of heat exchanger 60 and may optionally be blended with a second auxilliary charge stream of $C_2$–$C_6$ olefins flowing through line 42. A stream consisting of the cooled second intermediate product stream and optionally a second auxilliary charge stream is charged to tertiary reaction zone 73 through line 26. Partially deactivated zeolite catalyst flows downward from reaction 72 into reaction zone 73.

A product stream is withdrawn from reaction zone 73 via line 33. Deactivated catalyst is withdrawn from reaction zone 73 and charged to regeneration unit 80 via line 31. Regenerated catalyst then flows from regeneration unit 80 to direct heat exchange zone 90 through line 35. The operating temperature in regeneration unit 80 is maintained below the reactor outlet temperature of the product stream flowing through line 33. Thus the hot product stream is quenched to a temperature below that required to promote excessive cracking of the feed.

Direct heat exchange zone 90 includes a filter, perforate screen, gravitational settler, cyclonic separator, or other physical separation means to separate regenerated catalyst from the product stream after the regenerated catalyst is heated by quenching the hot product stream.

The residence time required to affect the desired direct heat exchange between the regenerated catalyst and the product stream determines the physical size of direct heat exchange zone 90. Factors affecting the necessary residence time include product stream temperature at the outlet of reaction zone 73, flowrate of the product stream, temperature and circulation rate of the regenerated catalyst as well as the heat capacity of the regenerated catalyst. Such heat transfer and equipment sizing calculations are within the capabilities of one of ordinary skill in the art.

Heated regenerated catalyst then flows from direct heat exchange zone 90 to reaction zone 71 through line 39. The quenched product stream flows to a product recovery section (not shown) through line 37.

Changes and modifications in the specifically described embodiments can be carried out without departing from the scope of the invention which is intended to be limited only by the scope of the appended claims.

What is claimed is:

1. A process for converting an aliphatic feedstream comprising the steps of:

(a) maintaining a catalyst in a reaction zone;

(b) contacting said aliphatic feedstream with said catalyst under conversion conditions evolving a product stream and at least partially deactivating said catalyst;

(c) separating said product stream from said catalyst;

(d) withdrawing a portion of said at least partially deactivated catalyst from said catalyst bed;

(e) regenerating said withdrawn portion of at least partially deactivated catalyst of step (b), above, at a temperature below that maintained in said reaction zone of step (a), above; and (f) quenching said product stream by directly contacting said product stream with regenerated catalyst to lower the temperature of said product stream sufficiently to avoid substantial thermal cracking of said product stream to light $C_2$-hydrocarbons.

2. The process of claim 1 wherein said catalyst is maintained in a fluid bed.

3. The process of claim 2 wherein said product stream is cyclonically separated from said catalyst.

4. The process of claim 3 wherein said separating step (c) and said quenching step (f) are carried out in at least one cyclonic separation zone.

5. The process of claim 3 wherein said separating step (c) further comprises flowing said product stream together with entrained catalyst to a cyclone separator and wherein said quenching step (f) further comprises flowing regenerated catalyst to said cyclone separator.

6. The process of claim 3 wherein said catalyst comprises a zeolite.

7. The process of claim 6 wherein said zeolite has a Constraint Index of between about 1 and about 12.

8. The process of claim 7 wherein said zeolite has the structure of at least one of the group consisting of ZSM-5, ZSM-11, ZSM-22, ZSM-23, ZSM-35 and ZSM-48.

9. The process of claim 8 wherein said zeolite has the structure of ZSM-5.

10. The process of claim 8 wherein said zeolite contains gallium.

11. The process of claim 1 wherein said catalyst comprises a metal on an inert support.

12. The process of claim 1 wherein said catalyst comprises a Group VIII metal on an inert support.

13. The process of claim 1 wherein said conversion conditions include temperatures between 500° and 820° C. (930° and 1500° F.), pressures between 170 and 2170 kPa (10 and 300 psig) and weight hourly space velocity between 0.3 and 300 $hr^{-1}$.

14. The process of claim 1 wherein said catalyst is maintained in a moving bed.

15. The process of claim 14 wherein said regenerated catalyst of step (e), above, is contacted with said product stream in a direct heat exchange zone.

16. The process of claim 14 wherein said catalyst comprises a zeolite.

17. The process of claim 16 wherein said zeolite has a Constraint Index of between about 1 and about 12.

18. The process of claim 17 wherein said zeolite has the structure of at least one of the group consisting of ZSM-5, ZSM-11, ZSM-22, ZSM-23, ZSM-35 and ZSM-48.

19. The process of claim 18 wherein said zeolite has the structure of ZSM-5.

20. The process of claim 18 wherein said zeolite contains gallium.

21. The process of claim 14 wherein said catalyst comprises a metal on an inert support.

22. The process of claim 21 wherein said catalyst comprises a Group VIII metal on an inert support.

23. The process of claim 14 wherein said conversion conditions include temperatures between 500° and 820° C. (930° and 1500° F.), pressures between 170 and 2170 kPa (10 and 300 psig) and weight hourly space velocity between 0.3 and 300 $hr^{-1}$.

24. An apparatus for converting an aliphatic feedstream comprising:

(a) a reactor vessel for the co-current downward flow of solid catalyst in contact with said aliphatic feedstream;

(b) a catalyst regeneration vessel in valved communication with said reactor vessel;

(c) temperature control means for maintaining the operating temperature of said catalyst regeneration vessel below the operating temperature of said reactor vessel;

(d) a direct heat exchange chamber for contacting fresh regenerated catalyst with a product stream withdrawn from said reactor vessel to preheat said fresh regenerated catalyst and to quench reactor effluent product thus lowering the temperature of said reactor effluent product sufficiently to avoid substantial thermal cracking of said reactor effluent product to light $C_2$-hydrocarbons;

(e) conduit means for transferring fresh regenerated catalyst from said regenerator vessel to said direct heat exchange chamber;

(f) conduit means for transferring reactor effluent product from said reactor vessel to said direct heat exchange chamber;

(g) means associated with said heat exchange chamber for separating said preheated regenerated catalyst from said reactor effluent product; and (h) conduit means for transferring said preheated regenerated catalyst to said reactor vessel.

25. An apparatus for converting an aliphatic feedstream comprising:

(a) a reactor vessel for maintaining a fluid bed of catalyst;

(b) a cyclone separator positioned within an upper section of said reactor vessel;

(c) a catalyst regenerator vessel in valved communication with said reactor vessel;

(d) temperature control means for maintaining the operating temperature of said catalyst regenerator vessel below the operating temperature of said reactor vessel; and (e) conduit means for withdrawing regenerated catalyst from said catalyst regenerator vessel and charging said regenerated catalyst to said cyclone separator at a rate sufficient to lower the temperature of reactor effluent product to avoid substantial thermal cracking of said reactor effluent product to $C_2$-light hydrocarbons.

* * * * *